United States Patent [19]

Bricker et al.

[11] Patent Number: 4,705,620

[45] Date of Patent: Nov. 10, 1987

[54] MERCAPTAN EXTRACTION PROCESS

[75] Inventors: Jeffery C. Bricker, Mt. Prospect; Bruce E. Staehle, Buffalo Grove, both of Ill.

[73] Assignee: UOP Inc., Des Plaines, Ill.

[21] Appl. No.: 942,147

[22] Filed: Dec. 16, 1986

[51] Int. Cl.[4] ..... C10G 19/00; C10G 19/08; C10G 45/00

[52] U.S. Cl. ..... 208/206; 208/226; 208/235; 204/73 R

[58] Field of Search ..... 204/73 R; 210/757; 208/226, 235, 206

[56] References Cited

U.S. PATENT DOCUMENTS

| | | | |
|---|---|---|---|
| 2,140,194 | 12/1938 | Yabroff et al. | 208/235 |
| 2,431,770 | 12/1947 | Payne et al. | 208/235 |
| 2,654,706 | 10/1953 | Gaylor | 208/235 |
| 2,853,432 | 9/1958 | Gleim et al. | 196/32 |
| 2,859,177 | 11/1958 | Ripple et al. | 208/235 |
| 2,921,021 | 1/1960 | Urban et al. | 208/235 |
| 2,988,500 | 6/1961 | Gleim et al. | 208/206 |
| 3,098,033 | 7/1963 | Weisang et al. | 208/235 |
| 3,108,081 | 10/1963 | Gleim et al. | 252/428 |
| 3,252,890 | 5/1966 | Warne | 208/206 |
| 3,408,287 | 4/1966 | Urban et al. | 208/207 |
| 3,574,093 | 4/1971 | Strong | 208/206 |
| 4,040,947 | 8/1977 | Christman | 208/235 |
| 4,072,584 | 2/1978 | Cipris et al. | 204/59 |
| 4,265,735 | 5/1981 | Audeh et al. | 208/235 |
| 4,362,614 | 12/1982 | Asdigian | 208/235 |
| 4,404,098 | 9/1983 | Asdigian | 208/235 |
| 4,562,300 | 12/1985 | La Foy | 208/235 |

*Primary Examiner*—Andrew Metz
*Assistant Examiner*—Helane Myers
*Attorney, Agent, or Firm*—Thomas K. McBride; John F. Spears, Jr.

[57] ABSTRACT

A process is disclosed for treating a sour hydrocarbon stream comprising extracting the mercaptans contained in said hydrocarbon stream with an alkaline solution in an extraction zone, oxidizing the mercaptans to disulfides in the presence of an oxidation catalyst, separating said disulfide from said alkaline solution, reducing the residual disulfides in said alkaline solution to mercaptans and recycling said alkaline solution to the extraction zone. Two ways are disclosed to effect the reduction of the disulfides to mercaptans: (1) hydrogenation with a supported metal catalyst and (2) electrochemical reduction.

26 Claims, 1 Drawing Figure

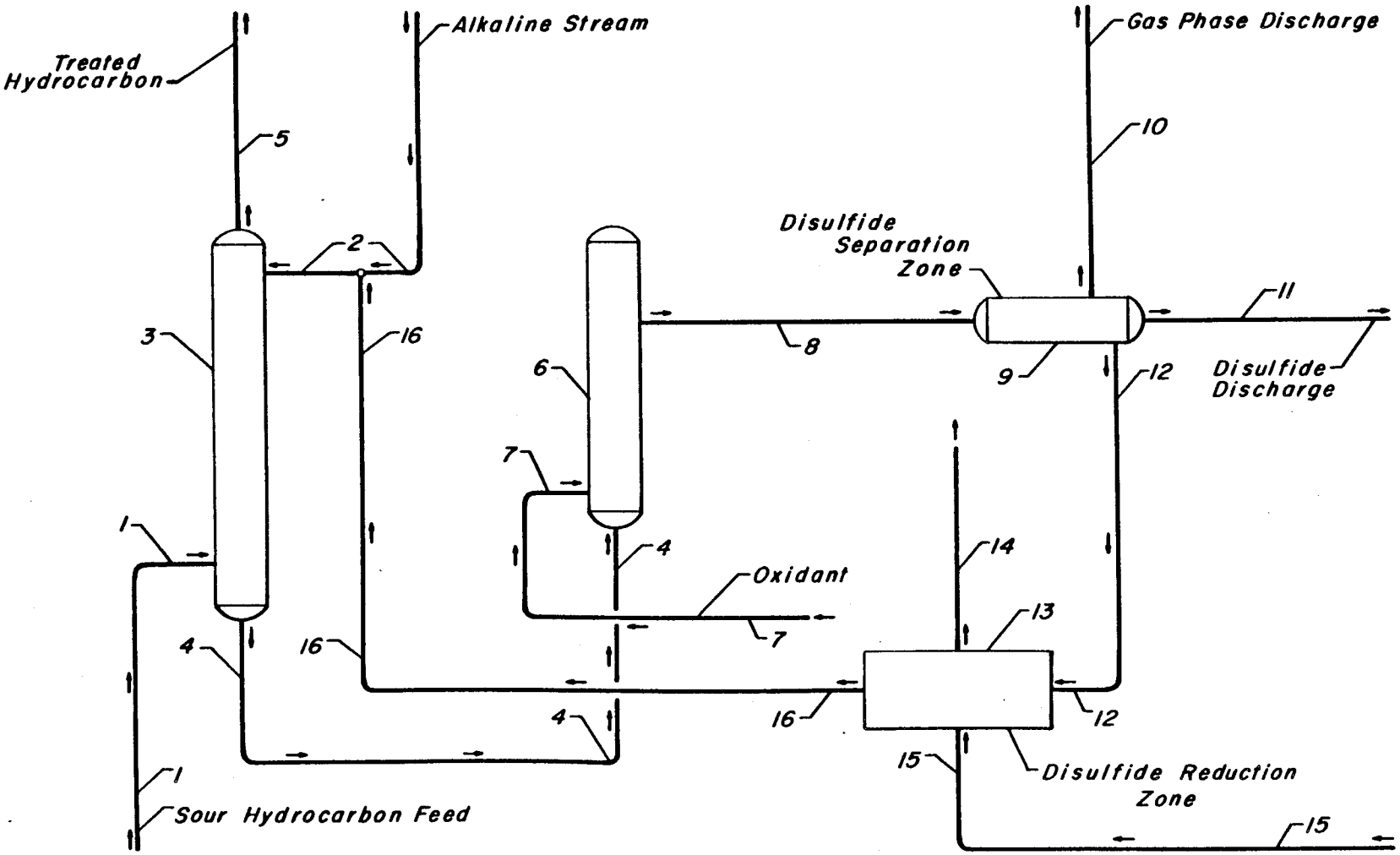
Gas Phase Discharge
10
11
Disulfide Discharge
12
9
Disulfide Separation Zone
8
Disulfide Reduction Zone
13
14
15
16
Oxidant
7
4
6
Alkaline Stream
2
5
Treated Hydrocarbon
3
1
Sour Hydrocarbon Feed

MERCAPTAN EXTRACTION PROCESS

BACKGROUND OF THE INVENTION

Traditionally the removal of mercaptans from various process materials and/or streams has been a substantial problem. The reasons for desiring this removal are well-known in the art and include: corrosion problems, burning problems, catalytic poisoning problems, undesired side reaction problems, offensive odor problems, etc.

The methods that have been proposed for the solution of this removal problem can be catagorized into those that seek the absolute removal of mercaptan compounds or any derivatives of these compounds from the carrier stream or material, and those that seek only to convert the mercaptans into a less harmful derivative with no attendant attempt at removal of these less harmful derivatives. Solutions of the former type are generally labeled as "extraction" processes. Solutions of the latter type are generally labeled as "sweetening" processes. Prominent among the extraction processes is a process which depends for its effectiveness on the fact that mercaptans are slightly acidic in nature and in the presence of a strong base tend to form salts—called mercaptides—which have a remarkably high preferential solubility in a basic solution. In this type of process, an extraction step is coupled with a regeneration step and an alkaline stream is continuously recirculated therebetween. In the extraction step, the alkaline stream is used to extract mercaptans from the hydrocarbon stream, and the resulting mercaptide rich alkaline stream is treated in the regeneration step to remove mercaptide compounds therefrom with continuous cycling of the alkaline stream between the extraction step and the regeneration step. The regeneration step is typically operated to produce disulfide compounds which are immiscible in the alkaline stream, and the major portion of which is typically separated therefrom in a settling step. In many cases, however, it is desired to remove substantially all disulfide compounds from the alkaline streams and complete separation of disulfide compounds from the alkaline stream in a settling step is not feasible because of the high dispersion of these compounds throughout the alkaline solution. Accordingly, the art has resorted to a number of sophisticated techniques in order to coalesce the disulfide compounds and effect their removal from the regenerated alkaline solution. One technique that has been utilized involves the use of a coalescing agent such as steel wool in order to spring disulfides from the regenerated alkaline solution. This technique, however, results in significant amounts of disulfides left in the alkaline solution. Another technique which has been widely utilized involves the use of one or more stages of a naphtha wash (see for example U.S. Pat. No. 3,574,093) in order to extract disulfide compounds from this alkaline solution. This technique has been widely utilized in the art, but it has several disadvantages: (1) it requires the availability of naphtha; (2) it requires large volumes of naphtha because of its low efficiency; (3) it requires a separate train of vessels and separators; and (4) it requires disposal of the contaminated naphtha.

As is well known to those skilled in the art, there are certain low boiling range hydrocarbon streams for which it is absolutely critical that the amount of sulfur compounds contained therein be held to a very low level. In many cases, this requirement is expressed as a limitation on the total amount of sulfur that can be tolerated in the treated stream—typically the requirement is for a sulfur content less than 50 wt. ppm calculated as elemental sulfur, and more frequently, the requirement is less than 10 wt. ppm sulfur. Accordingly, when a mercaptan extraction process of the type described above is designed to meet these stringent sulfur limitations, it is essential that the amount of disulfides contained in the regenerated alkaline solution be held to an extremely low level in order to avoid contamination of the extracted stream with disulfides. For example, in the sweetening of a hydrocarbon stream containing $C_3$ and $C_4$ hydrocarbons and about 750 wt. ppm mercaptan sulfur, an extraction process can easily be designed to produce a treated hydrocarbon distillate having about 5 wt. ppm mercaptan sulfur; however, without special treatment of the regenerated alkaline solution utilized, the total sulfur content of the treated hydrocarbon stream will be about 50 wt. parts per million because of disulfide compounds which are returned to the extraction step via the alkaline stream where they are transferred to the treated hydrocarbon stream.

The instant invention cures this problem by treating the disulfide containing alkaline solution in a reduction step whereby the disulfides are reduced back to mercaptans. Since the mercaptans are preferentially soluble in the alkaline phase, they are not transferred to the treated hydrocarbon stream. The reduction of disulfides to mercaptans is known in the art but is carried out for other purposes than that presented herein (See U.S. Pat. No. 4,072,584). Reduction of the disulfide can be accomplished by either hydrogenation of the disulfide with hydrogen over a hydrogenation catalyst or by electrochemical means wherein the disulfide is reduced at the cathode electrode of an electrochemical cell. Some of the broad advantages associated with this solution to the sulfur reentry problem are: (1) it eliminates the disposal problem and additional separation hardware required for naphtha washing; and (2) it minimizes the amount of mercaptides in the alkaline recycle stream charged to the extraction zone.

SUMMARY OF THE INVENTION

This invention relates to a process for continuously treating a sour hydrocarbon stream containing mercaptans in order to generate a purified stream of reduced mercaptan content and of reduced total sulfur compound content. More precisely, the present invention relates to a process for the treatment of a sour hydrocarbon fraction for the purpose of physically removing mercaptans contained therein which process comprises extracting the mercaptans in an extraction zone with an alkaline solution, oxidizing the mercaptans to disulfides in the presence of an oxidation catalyst, separating said disulfide from said alkaline solution, reducing the residual disulfides in said alkaline solution to mercaptans and recycling said alkaline solution to the extraction zone.

Accordingly, one embodiment of this invention provides a process for treating a sour hydrocabon stream containing mercaptans which comprises:

(a) contacting said hydrocarbon stream with an aqueous alkaline solution in an extraction zone at treating conditions to form a purified hydrocarbon stream and a mercaptide rich aqueous alkaline solution;

(b) separating and recovering said purified hydrocarbon stream from said mercaptide rich aqueous alkaline solution;

(c) passing said mercaptide rich aqueous alkaline solution to an oxidation zone and therein treating said mercaptide rich aqueous alkaline solution with an oxidizing agent in the presence of a metal phthalocyanine oxidation catalyst at oxidation conditions to oxidize the mercaptides to liquid disulfides;

(d) separating a major portion of said liquid disulfides from said aqueous alkaline solution which contains residual disulfides in a separation zone;

(e) passing said residual disulfide containing aqueous alkaline solution to a reduction zone and reducing said residual disulfides to mercaptans at reduction conditions; and, (f) recycling said mercaptan containing aqueous alkaline solution to said extraction zone.

In a specific embodiment, the invention provides a process for treating a sour hydrocarbon stream containing mercaptans which comprises:

(a) contacting said hydrocarbon stream with an aqueous sodium hydroxide solution in an extraction zone at a temperature of about 10° to about 100° C. and a pressure from ambient to 300 psig to form a purified hydrocarbon stream and a mercaptide rich aqueous sodium hydroxide solution.

(b) separating and recovering said purified hydrocarbon stream from said mercaptide rich aqueous sodium hydroxide solution;

(c) passing said mercaptide rich aqueous sodium hydroxide solution to an oxidation zone and therein oxidizing said mercaptide to disulfides with an excess amount of air in the presence of a cobalt phthalocyanine catalyst which is contained in said mercaptide rich sodium hydroxide solution at a temperature of 30° to 70° C., and a pressure of 30 to 100 psig.

(d) separating a major portion of said liquid disulfides from said aqueous sodium hydroxide solution which contains residual disulfides and the cobalt phthalocyanine catalyst in a separation zone;

(e) passing said residual disulfide containing aqueous sodium hydroxide solution to a reduction zone and reducing said residual disulfides to mercaptans by contacting said disulfides with hydrogen over a palladium on carbon hydrogenation catalyst; and, (f) recycling said mercaptan containing aqueous sodium hydroxide solution to said extraction zone.

Other objects and embodiments of the present invention encompass details about particular input hydrocarbon streams, catalysts for use in the oxidation and reduction steps thereof, mechanics associated with each of the essential steps thereof, and preferred operating conditions for each of the essential steps thereof.

DETAILED DESCRIPTION OF THE INVENTION

As heretofore stated, this invention relates to a process for treating a sour hydrocarbon stream. The sour hydrocarbon stream which is treated by the process is exemplified by one of the following: light petroleum gas (LPG), light naphtha, straight run naphthas, methane, ethane, ethylene, propane, propylene, butene-1, butene-2, isobutylene, butane, pentanes, etc.

The alkaline solution utilized in the present invention may comprise any alkaline reagent known to have the capability to extract mercaptans from relatively low boiling hydrocarbon streams. A preferred alkaline solution generally comprises an aqueous solution of an alkali metal hydroxide, such as sodium hydroxide, potassium hydroxide, lithium hydroxide, etc. Similarly, aqueous solutions of alkaline earth hydroxides such as calcium hydroxide, barium hydroxide, magnesium hydroxide, etc. may be utilized if desired. A particularly preferred alkaline solution for use in the present invention is an aqueous solution of about 1 to about 50% by weight of sodium hydroxide with particularly good results obtained with aqueous solutions having about 4 to about 25 wt. percent sodium hydroxide.

The catalyst which is used in the oxidation step is a metal phthalocyanine catalyst. Particularly preferred metal phthalocyanines comprise cobalt phthalocyanine and iron phthalocyanine. Other metal phthalocyanines include vanadium phthalocyanine, copper phthalocyanine, nickel phthalocyanine, molybednum phthalocyanine, chromium phthalocyanine, tungsten phthalocyanine, magnesium phthalocyanine, platinum phthalocyanine, hafnium phthalocyanine, palladium phthalocyanine, etc. The metal phthalocyanine in general is not highly polar and, therefore, for improved operation is preferably utilized as a polar derivative thereof. Particularly preferred polar derivatives are the sulfonated derivatives such as the monosul derivative, the disulfo derivative, the tri-sulfo derivative, and the tetra-sulfo derivative.

These derivatives may be obtained from any suitable source or may be prepared by one of two general methods (as described in U.S. Pat. Nos. 3,408,287 or 3,252,890). First, the metal phthalocyanine compound can be reacted with fuming sulfuric acid; or second, the phthalocyanine compound can be synthesized from a sulfo-substituted phthalic anhydride or equivalent thereof. While the sulfuric acid derivatives are preferred, it is understood that other suitable derivatives may be employed. Particularly, other derivatives include a carboxylated derivative which may be prepared, for example, by the action of trichloroacetic acid on the metal phthalocyanine or by the action of phosgene and aluminum chloride. In the latter reaction the acid chloride is formed and may be converted to the desired carboxylated derivative by conventional hydrolysis. Specific examples of these derivatives include: cobalt phthalocyanine monosulfonate, cobalt phthalocyanine disulfonate, cobalt phthalocyanine trisulfonate, cobalt phthalocyanine tetrasulfonate, vanadium phthalocyanine monosulfonate, iron phthalocyanine disulfonate, palladium phthalocyanine trisulfonate, platinum phthalocyanine tetrasulfonate, nickel phthalocyanine carboxylate, cobalt phthalocyanine carboxylate or iron phthalocyanine carboxylate.

The preferred phthalocyanine catalyst can be used in the present invention in one of two modes. First, it can be utilized in a water soluble form or a form which is capable of forming a stable emulsion in water as disclosed in U.S. Pat. No. 2,853,432. Second, the phthalocyanine catalyst can be utilized as a combination of a phthalocyanine compound with a suitable carrier material as disclosed in U.S. Pat. No. 2,988,500. In the first mode, the catalyst is present as a dissolved or suspended solid in the alkaline stream which is charged to the regeneration step. In this mode, the preferred catalyst is cobalt or vanadium phthalocyanine disulfonate which is typically utilized in an amount of about 5 to about 1,000 wt. ppm of the alkaline stream. In the second mode of operation, the catalyst is preferably utilized as a fixed bed of particles of a composite of the phthalocyanine compound with a suitable carrier material. The carrier material should be insoluble or substantially unaffected by the alkaline stream or hydrocarbon stream under the conditions prevailing in the various steps of the process. Activated charcoals are particularly preferred because of their high adsorptivity under these conditions. The amount of the phthalocyanine compound combined with the carrier material is preferably about 0.1 to about 2.0 wt. percent of the final composite. Additional details as to alternative carrier materials, methods of preparation, and the preferred amount of catalytic components for the preferred phthalocyanine catalyst for use in this second mode are given in the teachings of U.S. Pat. No. 3,108,081.

The disulfide reduction step can be accomplished either by hydrogenation using a hydrogenation catalyst and hydrogen or by electrochemically reducing the disulfide. Hydrogenation of the disulfide occurs via the following equation:

$$RSSR + H_2 \rightarrow 2\ RSH$$

In the preferred embodiment of the process the catalyst for the hydrogenation reaction consists of a metal on a solid support. The support can be chosen from the group comprising carbon, alumina, silica, aluminosilicates, zeolites, clays, etc. while the metal is preferably chosen from the metals of Group VIII of the Periodic Table and more preferably from the group comprising nickel, platinum, palladium, etc. The preferred supports are carbon based due to their stability in strong caustic and include activated carbons, synthetic carbons, and natural carbons as examples. Particularly preferred catalysts are: palladium on a carbon support and platinum on a carbon support.

In general, the palladium or platinum catalysts may be prepared by methods known in the art. For example, a soluble palladium salt can be contacted with a carbon support in order to deposite the desired amount of the palladium salts. Examples of soluble palladium salts which may be used are palladium chloride, palladium nitrate, palladium carboxylates, palladium sulfate and amine complexes of palladium chloride. This catalytic composite can then be dried and calcined. Finally, the finished palladium catalyst may be activated by reduction, if desired, by treatment with a reducing agent. Examples of reducing agents are gaseous hydrogen, hydrazine or formaldehyde.

The preferred catalyst is used under the following hydrogenation conditions: a hydrogen concentration of 10 to 100 times the stoichiometric amount required for the reaction, an LHSV from about 3 to about 18, and a temperature from about 30° C. to about 150° C. Preferred reaction conditions are a hydrogen concentration of 50–100 times the stoichiometric amount, a LHSV from about 6 to 12 and a temperature from about 50° C. to about 100° C.

Alternatively the disulfide can be reduced by electrochemical means. The electrochemical cell which may be employed to effect the reduction step in the present process consists of a cathode and an anode electrode, and an electrolytic solution. The cathode electrode may be chosen from the group of metals comprising zinc, lead, platinum, graphite, glossy carbon, synthetic carbons, cadmium, palladium, iron, nickel, copper, etc. while the anode electrode may be chosen from the group comprising platinun, graphite, iron, zinc, and brass electrode. The electrodes may also consist of a combination of the above metal systems, for example zinc coated graphite, or platinum coated graphite. The electrolytic solution is the disulfide containing alkaline solution itself. When a voltage is applied to the two terminals, the following reactions occur at the electrodes:

$$\begin{array}{ll} \text{CATHODE:} & RSSR + 2e^- - 2RS^- \\ \text{ANODE:} & H_2O - \tfrac{1}{2}O_2 + 2H^+ + 2e^- \\ \hline \text{NET:} & RSSR + H_2O - 2RSH + \tfrac{1}{2}O_2 \end{array}$$

The anode reaction is not limited to the oxidation of water and, in principle, may be any suitable oxidation which can be coupled with the disulfide reduction reaction of complete the electrochemical reaction. This electrochemical process can be done either as a batch process or as a continuous process, with the continuous process being preferred. A voltage from about 1.3 v to about 3.0 v is applied with the preferred voltage being from about 1.5 v to about 2.5 v.

BRIEF DESCRIPTION OF THE DRAWING

This invention will be further described with reference to the attached drawing which is schematic outline of the process under discussion. The attached drawing is merely intended as a general representation of a preferred flow scheme with no intent to give details about vessels, heaters, condensers, pumps, compressors, valves, process control equipment, etc. except where a knowledge of these devices is essential to the understanding of this invention or would not be self-evident to one skilled in the art.

Referring now to the attached drawing, a hydrocarbon stream enters the process via line 1 into extraction zone 3. The aqueous alkaline solution containing the phthalocyanine catalyst enters the process via line 2 into extraction zone 3. Extraction zone 3 is typically a vertically positioned tower containing suitable contacting means such as baffle pans, trays, and the like designed to effect intimate contact between the two liquid streams charged thereto. In extraction zone 3 the sour hydrocarbon stream is counter-currently contacted with an alkaline solution containg a phthalocyanine catalyst which enters the extraction zone via line 2. When desired, fresh alkaline solution may be introduced into the system by an extension of line 2.

The function of extraction zone 3 is to bring about intimate contact between the sour hydrocarbon stream and the alkaline stream such that the mercaptans contained in the hydrocarbon stream are preferentially dissolved in the alkaline solution. The rate of flow of the sour hydrocarbon stream and the alkaline solution are adjusted so that the treated hydrocarbon stream leaving the extraction zone 3 via line 5 contains substantially less mercaptans than the sour hydrocarbon stream introduced via line 1. In this manner zone 3 acts to both extract the mercaptans from the sour hydrocarbon stream into the alkaline solution and to separat the treated hydrocarbon stream from the alkaline solution.

Extraction zone 3 is preferably operated at a temperature of about 25° to about 100° C. and more preferably at a temperature of about 30° to about 75° C. Likewise, the pressure utilized within zone 3 is generally selected to maintain the hydrocarbon stream in liquid phase, and may range from ambient up to about 300 psig. For an LPG stream the pressure is preferably about 140 to about 175 psig. The volume loading of the alkaline stream relative to the hydrocarbon stream is preferably about 1 to about 30 vol. percent of the hydrocarbon stream with excellent results obtained for an LPG type stream when the alkaline stream is introduced into zone 3 in an amount of about 5% of the hydrocarbon stream.

The mercaptide rich alkaline stream is passed via line 4 to oxidation zone 6 where it is commingled with the oxidant which enters the oxidation zone 6 via line 7. The amount of oxidant such as oxygen or air commingled with the alkaline stream is ordinarily at least the stoichiometric amount necessary to oxidize mercaptides contained in the alkaline stream to disulfides. In general, it is a good practice to operate with sufficient oxidant to ensure that the reaction goes essentially to completion. The oxidant used for this step comprises an oxygen-containing gas such as oxygen or air with air usually being the oxidant of choice for economic and availability reasons. The function of zone 6 is to regenerate the alkaline solution by oxidizing the mercaptide compounds to disulfides; as pointed out hereinbefore, this regeneration step is preferably performed in the presence of a phthalocyanine catalyst which is present as a solution in the alkaline stream. In the preferred embodiment of the apparatus, a suitable packing material is utilized in order to effect intimate contact between the catalyst, the mercaptides and oxygen.

Zone 6 is preferably operated at a temperature corresponding to the temperature of the entering mercaptide rich alkaline solution which is typically in the range of about 35° to about 70° C. The pressure used in zone 6 is generally substantially less than that utilized in the extraction zone. For instance, in a typical embodiment wherein extraction zone 3 is run at a pressure from about 140 to about 175 psig, zone 6 is preferably operated at about 30 to about 70 psig.

An effluent stream containing nitrogen, disulfide compounds, alkaline solution and optionally phthalocyanine catalyst is withdrawn therefrom via line 8 and passed to a separating zone 9 which is preferably operated at the conditions used in zone 6. In zone 9 the effluent stream is allowed to separate into (a) a gas phase which is withdrawn via line 10 and discharged from the process, (b) a disulfide phase which is substantially immiscible with the alkaline phase and is withdrawn from the process via line 11 and (c) an alkaline phase which is withdrawn via line 12. In general, the complete coalescence of the disulfide compound into a separate phase is extremely difficult to achieve without the aid of suitable coalescing agents such as a bed of steel wool, sand, glass, etc. In addition, a relatively high residence time of about 0.5 to 2 hours is typically used within zone 9 in order to further facilitate this phase separation. Despite these precautions, the regenerated alkaline stream which is withdrawn via line 12 inevitably contains minor amounts of disulfide compounds and mercaptide compounds. In fact, the amount of sulfur present in this regenerated alkaline stream can build up during the course of a prolonged recycle operation such that complete treatment of the sour hydrocarbon stream in extraction zone 3 is not possible.

In accordance with the present invention, the regenerated alkaline solution is passed to zone 13 via line 12. The function of zone 13 is to reduce the disulfides entrapped in the alkaline solution. Zone 13 can be configured in one of two configurations: a catalytic hydrogenation or an electrochemical reduction configuration.

In the catalytic hydrogenation configuration, zone 13 preferably contains a fixed bed catalyst of 10–30 mesh particles comprising palladium on carbon. Hydrogen is charged to zone 13 via line 15 and intermingled with the alkaline solution in contact with the hydrogenation catalyst thereby reducing the disulfides to mercaptides. This zone is preferably operated at a temperature of about 30° C. to about 150° C., a pressure of about 30 psig to about 150 psig, an LHSV of about 1 to about 20 and a hydrogen concentration of about 10 to about 100 times the stoichiometric amount. In the preferred embodiment of the invention the reduction conditions will include a temperature of about 40° C. to about 100° C., an LHSV of about 3 to about 15, a pressure of about 50 psig to about 125 psig and a hydrogen concentration of about 15 to about 30 times the stoichiometric amount. The effluent stream is separated into an unreacted hydrogen gas phase which is withdrawn via line 14 and discharged from the process and an alkaline aqueous phase which is withdrawn via line 16, joined to line 2 and cycled to extraction zone 3.

Alternatively the hydrogenation catalyst can comprise a soluble hydrogenation catalyst, such as a Group VIII carboxylate, and be present in the alkaline solution throughout the entire process. In this case, zone 13 is preferably operated at a temperature of about 30° C. to about 125° C., a pressure of about 30 psig to about 150 psig, a residence time of about 3 mw to about 30 mw and a hydrogen concentration of about 10 to about 100 times the stoichiometric amount. In the preferred embodiment of the invention the reduction conditions will include a temperature of about 40° C. to about 100° C., an LHSV of about 3 to about 15, a pressure of about 50 psig to about 125 psig and a hydrogen concentration of about 15 to about 30 times the stoichiometric amount.

In the electrochemical configuration, zone 16 comprises an electrochemical cell consisting of a cathode, an anode and an electrolytic solution. The electrolytic solution is the to-be-treated alkaline solution which is introduced into zone 13 via line 12. The cathode electrode of the cell is preferably graphite. The anode electrode is preferably platinum or graphite. This electrochemical reduction can be carried out either as a batch process or a continuous process. A voltage from about 1.3 v to about 3.0 v is applied with the preferred voltage being from about 1.5 v to about 2.5 v. When operated as a batch process, the residence time is preferably about 30 min to about 240 min, while when operated as a continuous process a residence time of about 3 min to about 30 min is preferred. As in the catalytic hydrogenation reduction, the effluent stream separates into a gas phase, primarily comprising oxygen which is withdrawn via line 14 and an alkaline aqueous phase which is withdrawn via line 16, joined to line 2 and cycled to extraction zone 3.

The following examples are given to illustrate further the process of the present invention, and indicate the benefits to be afforded by the utilization thereof. In particular the examples describe only the reduction part of the invention. It is understood that the examples are given for the sole purpose of illustration and are not considered to limit the generally broad scope and spirit of the appended claims.

EXAMPLE 1

A palladium on carbon hydrogenation catalyst was prepared in the following manner. To a beaker containing 500 mL of deionized water was added 7.5 grams of palladium nitrate, Pd $(NO_3)_2 \times H_2O$. In a separate beaker 200 grams (450 mL) of 10–30 mesh carbon was wetted with 450 mL of deionized water. The palladium nitrate solution and the wetted carbon were mixed in a rotary evaporator and rolled for about 15 minutes.

After this period of time, the evaporator was heated by introducing steam into the evaporator so that the aqueous phase was evaporated. The complete evaporation of the aqueous phase took about 3 hours. Next the impregnated catalyst was dried in a forced air oven for 3 hours at 80° C. Finally the dried catalyst was then calcined under nitrogen at 400° C. for 2 hours. The final catalyst composite contained 1.13% Pd by weight.

A commercial alkaline solution having a disulfide content of 298 wt. ppm was contacted with the 10–30 mesh fixed bed palladium on carbon catalyst described above at an LHSV of 10, a temperature of 75° C., a pressure of 100 psig and a hydrogen concentration of 80 times the stoichiometric amount. After three hours, the effluent was analyzed for disulfides and it was determined that 74% of the disulfides were being converted to mercaptans. The feed stream was continuously fed through the reaction vessel containing the catalyst at the conditions stated herein for 110 hours at which point the conversion of disulfide to mercaptan was found to be 90%.

Clearly this process is effective in reducing the disulfides to mercaptans at a high yield. Therefore, the instant invention significantly reduces the disulfide content of the alkaline stream recycled to the extraction zone described hereinbefore.

EXAMPLE II

A zinc cathode electrode and a platinum anode electrode were placed in a 500 ml beaker. 300 ml of a 6.0% sodium hydroxide solution containing 300 wt. ppm disulfide were added to the beaker and a voltage of −1.8 V was applied across the two electrodes. After 4 hours the solution was analyzed for disulfides and it was determined that 53% of the disulfides were converted to mercaptans.

It is observed that the electrochemical reduction of disulfides to mercaptans using a zinc cathode electrode is an effective way to minimize the entry of disulfides into the extraction zone.

EXAMPLE III

A lead cathode electrode and a platinum anode electrode were placed in a 500 ml beaker. 300 ml of a 6.0% sodium hydroxide solution containing 300 wt. ppm disulfide were added to the beaker and a voltage of −1.8 V was applied across the two electrodes. After 4 hours the solution was analyzed for disulfides and it was determined that 39% of the disulfides were converted to mercaptans.

It is observed, therefore, that the electrochemical reduction of disulfides to mercaptans using a lead cathode electrode is an effective way to minimize the entry of disulfides into the extraction zone which would increase the total sulfur content of the treated hydrocarbon stream.

EXAMPLE IV

A graphite rod cathode electrode and a platinum anode electrode were placed in a 500 mL beaker. To this beaker there was added 300 mL of a 6.0% sodium hydroxide solution containing 300 wt. ppm of disulfide and a voltage of −1.8 v was applied across the two electrodes. After a 6 hour period 25% of the disulfides were converted to mercaptans.

It is observed, therefore, that the electrochemical reduction of disulfides to mercaptans using a graphite electrode is an effective way to minimize the entry of disulfides into the extraction zone.

In addition, carbon based electrodes such as graphite show very high stability to strongly alkaline solutions, making carbon based electrodes the preferred material for the cathode electrode.

We claim as our invention:

1. A process for treating a sour hydrocarbon stream containing mercaptans which comprises:

(a) contacting said hydrocarbon stream with an aqueous alkaline solution in an extraction zone at treating conditions to form a purified hydrocarbon stream and a mercaptide rich aqueous alkaline solution;

(b) separating and recovering said purified hydrocarbon stream from said mercaptide rich aqueous alkaline solution:

(c) passing said mercaptide rich aqueous alkaline solution to an oxidation zone and therein treating said mercaptide rich aqueous alkaline solution with an oxidizing agent in the presence of a metal phthalocyanine oxidation catalyst at oxidation conditions to oxidize the mercaptides to liquid disulfides;

(d) separating a major portion of said liquid disulfides from said aqueous alkaline solution which contains residual disulfides in a separation zone;

(e) passing said residual disulfide containing aqueous alkaline solution to a reduction zone and reducing said residual disulfides to mercaptans at reduction conditions; and, (f) recycling said mercaptan containing aqueous alkaline solution to said extraction zone.

2. The process of claim 1 in which said hydrocarbon stream comprises light paraffin gases ($C_1$–$C_4$ hydrocarbon).

3. The process of claim 1 in which said hydrocarbon stream comprises light naphtha ($C_4$–$C_6$ hydrocarbon).

4. The process of claim 1 in which said treating conditions comprise a temperature from about 10° to about 100° C. and a pressure from about ambient to about 300 psig.

5. The process of claim 1 in which said oxidation conditions comprise a temperature in the range of from about 35° to about 70° C., a pressure in the range of from about ambient to about 100 psig and an air concentration from about stoichiometric to about 1.5 the stoichiometric amount.

6. The process of claim 1 in which said reduction is effected in the presence of a hydrogenation catalyst, a hydrogen concentration in the range of from about 10 to about 100, a temperature in the range of from about 40° C. to about 100° C. and a pressure in the range of from about 50 to about 125 psig.

7. The process of claim 1 in which said reduction is effected in an electrochemical cell consisting of an active electrode and a counter electrode such that the disulfides are electrochemically reduced to mercaptans.

8. The process of claim 7 in which the active electrode is further characterized as being selected from the group comprising zinc, lead, platinum, graphite, glossy carbon, carbon, cadmium, palladium, iron, nickel and copper.

9. The process of claim 7 in which the counter electrode is further characterized as comprising platimun.

10. The process of claim 7 in which the counter electrode is further characterized as comprising graphite.

11. The process of claim 6 in which said hydrogenation catalyst is further characterized as comprising from about 0.01 to about 5 wt. % palladium supported on carbon.

12. The process of claim 6 in which said hydrogenation catalyst is further characterized as comprising from about 0.1 to about 8 wt. % platinum supported on carbon.

13. The process of claim 6 in which said hydrogenation catalyst is characterized as comprising from about 0.1 to about 8 wt. % nickel supported on alumina.

14. The process of claim 6 in which said hydrogenation catalyst is further characterized as comprising a Group VIII metal carboxylate and is present in the alkaline solution.

15. The process of claim 14 in which said metal carboxylate is further characterized as a palladium carboxylate.

16. The process of claim 14 in which said metal carboxylate is further characterized as comprising a nickel carboxylate.

17. The process of claim 1 in which said alkaline solution is either sodium hydroxide or potassium hydroxide.

18. The process of claim 12 in which said alkaline solution is further characterized as having a pH in the range of from about a pH of 8 to about a pH of 14.

19. The process of claim 1 in which said metal phthalocyanine catalyst is selected from the group comprising a Group VIII metal phthalocyanine sulfonate.

20. The process of claim 18 in which said metal phthalocyanine sulfonate is further characterized as comprising cobalt phthalocyanine sulfonate.

21. The process of claim 18 in which said metal phthlocyanine sulfonate is further characterized as comprising iron phthalocyanine sulfonate.

22. The process of claim 18 in which said metal phthalocyanine sulfonate is present as a dissolved or suspended solid in the alkaline stream.

23. The process of claim 18 in which said metal phthalocyanine sulfonate is supported on a suitable carrier material.

24. The process of claim 23 in which said carrier material comprises activated charcoals.

25. The process of claim 1 in which said oxidizing agent is oxygen.

26. The process of claim 1 in which said oxidizing agent is air.

* * * * *